US008414332B2

(12) United States Patent
Ju et al.

(10) Patent No.: US 8,414,332 B2
(45) Date of Patent: Apr. 9, 2013

(54) SHIELDED CONNECTOR

(75) Inventors: Ted Ju, Keelung (TW); Shang Ju Tsai, Keelung (TW)

(73) Assignee: Lotes Co., Ltd., Keelung (TW)

( * ) Notice: Subject to any disclaimer, the term of this patent is extended or adjusted under 35 U.S.C. 154(b) by 185 days.

(21) Appl. No.: 13/104,857

(22) Filed: May 10, 2011

(65) Prior Publication Data

US 2012/0171897 A1 Jul. 5, 2012

(30) Foreign Application Priority Data

Jan. 4, 2011 (CN) ..... 2011 1 0001994

(51) Int. Cl.
*H01R 13/648* (2006.01)

(52) U.S. Cl.
USPC ..... 439/607.02; 439/342

(58) Field of Classification Search ..... 439/607.1, 439/626, 630, 71, 862, 342, 607.03, 607.02, 439/607.13; 174/94 R
See application file for complete search history.

(56) References Cited

U.S. PATENT DOCUMENTS

| | | | | |
|---|---|---|---|---|
| 7,871,274 | B2 * | 1/2011 | Chiang | 439/66 |
| 8,118,603 | B2 * | 2/2012 | Ho | 439/70 |
| 8,167,652 | B1 * | 5/2012 | Ju | 439/607.13 |
| 8,277,256 | B2 * | 10/2012 | Ju | 439/626 |
| 2007/0167037 | A1 * | 7/2007 | Thiel et al. | 439/70 |
| 2012/0196481 | A1 * | 8/2012 | Ju | 439/626 |

* cited by examiner

*Primary Examiner* — Hae Moon Hyeon
(74) *Attorney, Agent, or Firm* — Morris Manning & Martin LLP; Tim Tingkang Xia, Esq.

(57) ABSTRACT

A shielded connector. In one embodiment, the shielded connector includes: a seat, including an insulating body with a plurality of through slots and a plurality of positioning slots, in which a shielding body is disposed in the through slot and no shielding body is disposed in the positioning slot, at least one conductive body connected to the shielding bodies, and at least one lead-out portion electrically connecting the conductive body to a motherboard; and a plurality of conductive terminals, each including a contact portion, a body portion extending from the contact portion, and a connecting portion, in which the body portion includes a positioning section extending from the contact portion and in interference fit with the positioning slot, and a conducting section extending from the positioning section into the through slot and not in interference fit with the through slot.

12 Claims, 2 Drawing Sheets

SHIELDED CONNECTOR

CROSS-REFERENCE TO RELATED APPLICATIONS

This non-provisional application claims priority under 35 U.S.C. §119(a) on Patent Application No. 201110001994.5 filed in China, P.R.C. on Jan. 4, 2011, the entire contents of which are hereby incorporated by reference.

FIELD OF THE INVENTION

The present invention relates to a shielded connector, and more particularly to a shielded connector capable of avoiding short circuit between a conductive terminal and a shielding body.

BACKGROUND OF THE INVENTION

To solve the problem of electromagnetic interference during signal transmission, a shielded connector has been proposed in the prior art, which electrically connects a mating electronic component to a motherboard and includes a seat and a plurality of conductive terminals accommodated in the seat.

The seat includes: a plurality of receiving slots, in which a shielding body is disposed on an inner surface of each of the receiving slots, an isolator is disposed over the shielding body, and the isolator is used for electrically insulating the conductive terminal from the shielding body; a conductive body, located on a bottom surface of the seat, and communicating the shielding bodies; and two lead-out portions, electrically connecting the conductive body to the motherboard, and located on the bottom surface of the seat.

The conductive terminals are correspondingly accommodated in the receiving slots. Each of the conductive terminals includes: a contact portion, exposed at one side of the seat and in electrical contact with the mating electronic component; a body portion, extending from the contact portion into the receiving slot, in which the width of the body portion is greater than the width of the receiving slot, and the body portion and the receiving slot are in interference fit, so as to fix the conductive terminal in the seat; and a connecting portion, extending from the body portion, exposed at the other side of the seat, and electrically conducted with the motherboard.

However, since the body portion and the receiving slot are in interference fit, in the process of mounting the conductive terminal into the receiving slot, the body portion may scratch the isolator over the shielding body and further scrape the isolator or even peel off the isolator from the shielding body, which causes that a part of the shielding body is uncovered and is in short circuit with the conductive terminal.

In view of the above, the shielded connector in the prior art has the defect that short circuit easily occurs between the conductive terminal and the shielding body.

Therefore, a heretofore unaddressed need exists in the art to address the aforementioned deficiencies and inadequacies.

SUMMARY OF THE INVENTION

Accordingly, the present invention is directed to a shielded connector capable of avoiding short circuit between a conductive terminal and a shielding body.

In one aspect of the present invention, a shielded connector is provided. The shielded connector of the present invention includes: a seat, including an insulating body with a plurality of through slots formed through one side of the insulating body and a plurality of positioning slots further recessed from the through slots and formed through the other side of the insulating body, in which a shielding body is disposed in the through slot and no shielding body is disposed in the positioning slot, at least one conductive body disposed outside the positioning slots and the through slots and connected to the shielding bodies, and at least one lead-out portion disposed outside the positioning slots and the through slots and electrically connecting the conductive body to the motherboard; and a plurality of conductive terminals, disposed in the insulating body, each including a contact portion exposed at one side of the insulating body and in electrical contact with the mating electronic component, a body portion extending from the contact portion, and a connecting portion extending from the body portion, exposed at the other side of the insulating body and electrically connected to the motherboard, in which the body portion includes a positioning section extending from the contact portion and in interference fit with the positioning slot, and a conducting section extending from the positioning section into the through slot and not in interference fit with the through slot.

As compared with the prior art, in the shielded connector of the present invention, since the positioning section of the conductive terminal is in interference fit with the positioning slot and meanwhile the conducting section of the conductive terminal is not in interference fit with the through slot, the conductive terminal can be stably retained in the insulating body while avoiding short circuit between the conductive terminal and the shielding body.

In another aspect of the present invention, a shielded connector is provided. The shielded connector includes: a seat, including an insulating body with a plurality of through slots formed through the insulating body and a plurality of positioning slots adjacent to the through slots and separated from the through slots by a barrier respectively, in which a shielding body is disposed in the through slot and no shielding body is disposed in the positioning slot, at least one conductive body disposed outside the positioning slots and the through slots and connected to the shielding bodies, and at least one lead-out portion disposed outside the positioning slots and the through slots and electrically connecting the conductive body to the motherboard; and a plurality of conductive terminals, disposed in the insulating body, each including a contact portion exposed at one side of the insulating body and in electrical contact with the mating electronic component, a body portion extending from the contact portion, and a connecting portion extending from the body portion, exposed at the other side of the insulating body and electrically connected to the motherboard, in which the body portion includes a connecting section connected to the contact portion and extending across the barrier, a positioning section extending from the connecting section and in interference fit with the positioning slot, and a conducting section extending from the contact portion into the through slot and not in interference fit with the through slot.

As compared with the prior art, in the shielded connector of the present invention, since the positioning section of the conductive terminal is in interference fit with the positioning slot and meanwhile the conducting section of the conductive terminal is not in interference fit with the through slot, the conductive terminal can be stably retained in the insulating body while avoiding short circuit between the conductive terminal and the shielding body.

In yet another aspect, a method for manufacturing a shielded connector is provided. The method includes:

forming an insulating body by injection-molding and plotting a pre-plating side on the insulating body, so that the insulating body has a plurality of through slots recessed from the pre-plating side and a plurality of positioning slots disposed adjacent to the through slots; plating a conductive layer from the pre-plating side towards the through slot and the pre-plating side, so that the conductive layer is not disposed in the positioning slot; arranging an insulating layer, so that the insulating layer is formed over the conductive layer in the through slot and covers a part of the conductive layer of the pre-plating side; forming a plurality of conductive terminals by stamping, so that each of the conductive terminals includes a contact portion, a body portion and a connecting portion connected in sequence; and assembling the conductive terminal into the insulating body, so that the contact portion is exposed at one side of the insulating body, the body portion is in interference fit with the positioning slot and is not in interference fit with the through slot, and the connecting portion is exposed at the other side of the insulating body.

As compared with the prior art, since the positioning section of the conductive terminal is in interference fit with the positioning slot and meanwhile the conducting section of the conductive terminal is in clearance fit with the through slot, the conductive terminal can be stably retained in the insulating body while avoiding short circuit between the conductive terminal and the shielding body.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

Figure 1:
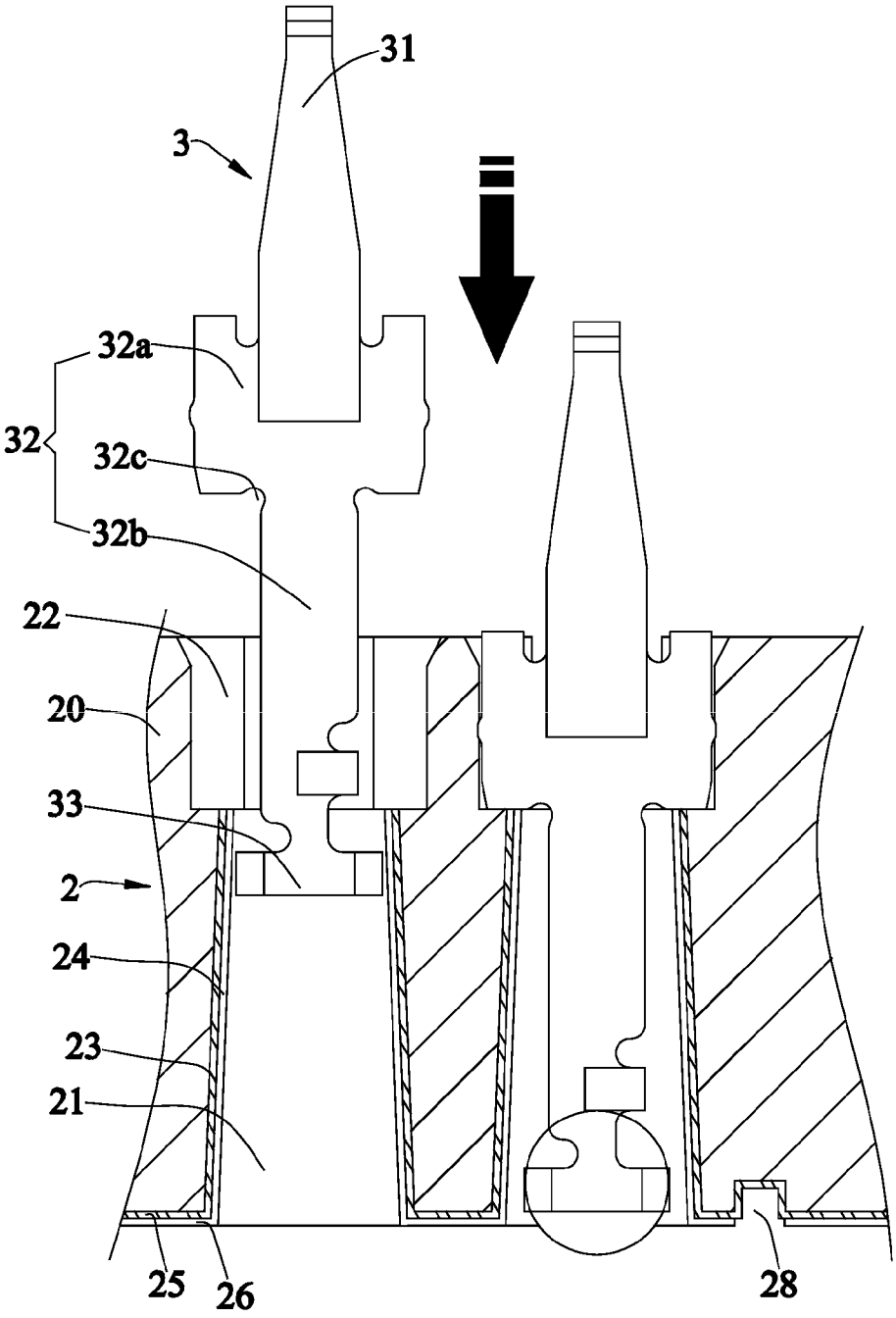
FIG. 1 is a schematic partial sectional view of a shielded connector according to a first embodiment of the present invention.
Figure 2:
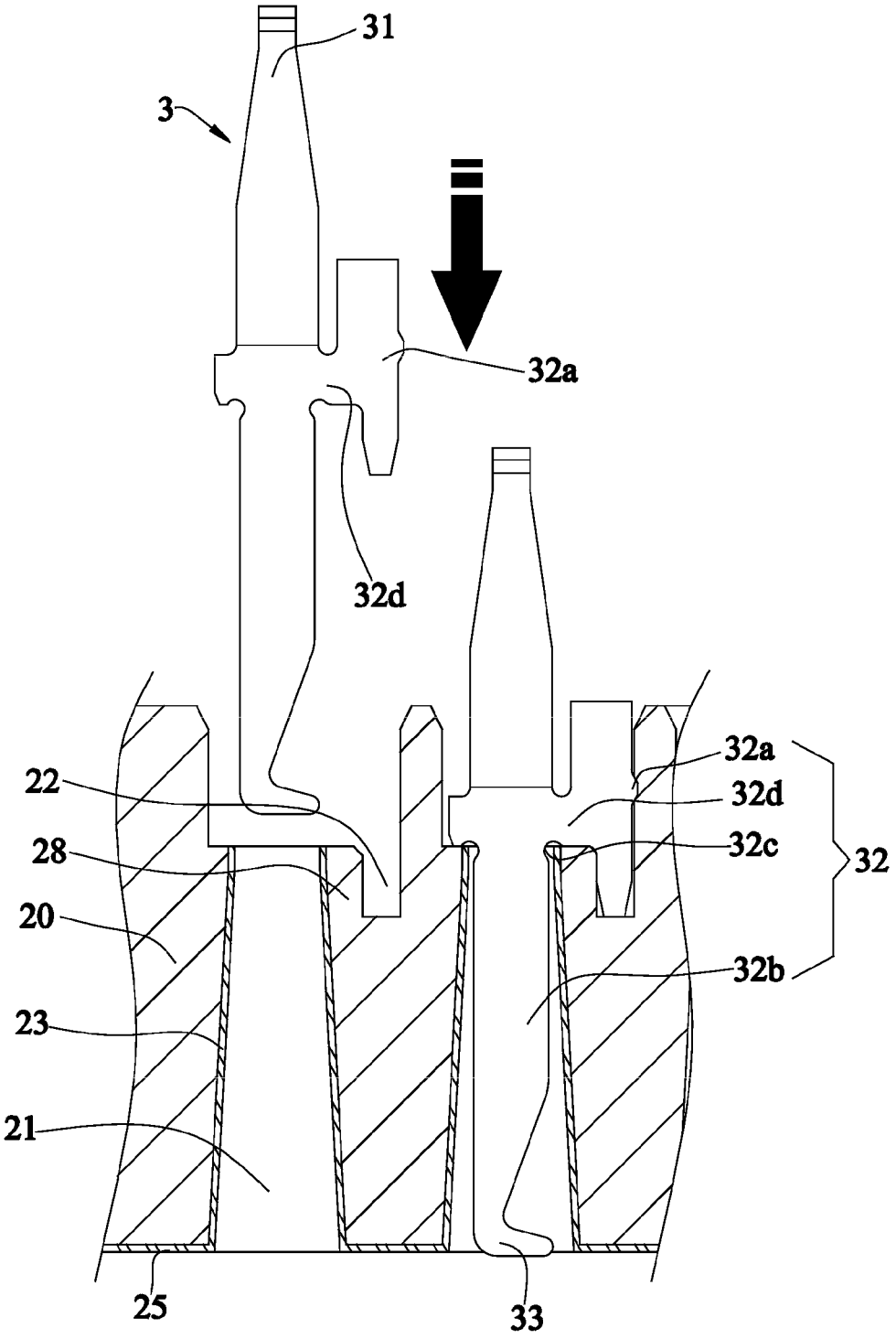
FIG. 2 is a schematic partial sectional view of a shielded connector according to a second embodiment of the present invention.

List of Reference Numerals in FIGS. 1-2:

| | | |
|---|---|---|
| Seat 2 | | |
| Insulating body 20 | Through slot 21 | Positioning slot 22 |
| Shielding body 23 | Isolator 24 | Conductive body 25 |
| Spacer 26 | Barrier 28 | |
| Conductive terminal 3 | | |
| Contact portion 31 | Body portion 32 | Connecting portion 33 |
| Positioning section 32a | Conducting section 32b | Notch 32c |
| Connecting section 32d | | |

DETAILED DESCRIPTION OF THE INVENTION

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The shielded connector of the present invention is further described in detail below with reference to the accompanying drawings and specific embodiments.

Referring to FIG. 1, the shielded connector of the present invention connects a mating electronic component (not shown) to a motherboard (not shown), and includes a seat 2 and a plurality of conductive terminals 3 accommodated in the seat 2.

The seat 2 includes an insulating body 20. The insulating body 20 is disposed with a plurality of through slots 21 recessed inwards from a bottom surface of the insulating body 20, and a plurality of positioning slots 22 further recessed from the through slots 21 and formed through a top surface of the insulating body 20. The positioning slots 22 are one-to-one corresponding to the through slots 21 (alternatively, the numbers of the positioning slots 22 and the through slots 21 may be different according to the design requirements).

The through slot 21 gradually shrinks from the bottom surface of the insulating body 20 towards the positioning slot 22. Particularly, a shielding body 23 is disposed on an inner wall of the through slot 21, and the inner wall of the through slot 21 where the shielding body 23 is disposed is inclined towards the motherboard, so that the inner wall of the through slot 21 is exposed to the outside, and the projection of the inner wall of the through slot 21 where the shielding body 23 is disposed on the motherboard is continuous but not overlapped. An isolator 24 is disposed over the shielding body 23.

An inner wall of the positioning slot 22 is upright and perpendicular to the top surface of the insulating body 20, and no shielding body 23 is disposed in the positioning slot 22.

Since the inner wall of the through slot 21 is inclined towards the motherboard, during vacuum sputtering, the metal ions are sputtered towards the inner wall of the through slot 21, thus forming the shielding body 23 on the inner wall of the through slot 21. Meanwhile, since the inner wall of the positioning slot 22 is upright, during vacuum sputtering, the sputtered metal ions easily pass out of the positioning slot 22 directly and are not easily deposited on the inner wall of the positioning slot 22 to form the continuous shielding body 23. Therefore, it can be ensured that the shielding body 23 is not plated in the positioning slot 22.

The seat 2 further includes a conductive body 25. The conductive body 25 is disposed outside the through slots 21 and the positioning slots 22. In particular, the conductive body 25 is disposed at the bottom surface of the insulating body 20 and the conductive body 25 may also be formed on the bottom surface of the insulating body 20 by vacuum sputtering. The conductive body 25 is connected to the shielding bodies 23 of the through slots 21, and a spacer 26 is disposed outside of the conductive body 25.

The seat 2 further includes four lead-out portions (not shown) disposed outside the through slots 21 and the positioning slots 22. In particular, the lead-out portions are disposed at corners of the bottom surface of the insulating body 20, the lead-out portions may also be formed on the bottom surface of the insulating body 20 by vacuum sputtering, and the lead-out portions connect the conductive body 25 to the motherboard.

Each conductive terminal 3 includes a contact portion 31 exposed outside the positioning slot 22 and electrically conducted with the mating electronic component, a body portion 32 extending from the contact portion 31, and a connecting portion 33 extending from the body portion 32, exposed outside the through slot 21 and electrically conducted with the motherboard.

The body portion 32 includes a positioning section 32*a* extending from the contact portion 31 and in interference fit with the positioning slot 22 to retain the conductive terminal 3 in the insulating body 20, and a conducting section 32*b* extending from the positioning section 32*a*, received in the through slot 21 and not in interference fit with the through slot 21.

In one embodiment of the present invention, the positioning section 32*a* is in interference fit with the positioning slot 22, and meanwhile, the conducting section 32*b* is not in interference fit with the through slot 21. Therefore, the conductive terminal 3 can be stably disposed in the insulating body 20 without damaging the isolator 24, thus further avoiding short circuit between the shielding body 23 and the conductive terminal 3.

In this embodiment, the isolator 24 and the spacer 26 are both insulating layers and are integrally formed, and the insulating layer is an ultraviolet curing paint layer, a polyurethane resin coating layer or a varnish layer.

The assembling process of the shielded connector of one embodiment is described as follows.

The conductive terminal 3 is placed above the insulating body 20 in alignment with the positioning slot 22. The conductive terminal 3 is pushed downwards so that the connecting portion 33 of the conductive terminal 3 passes through the positioning slot 22 and the through slot 21 and is finally exposed outside the through slot 21. At this time, the positioning section 32*a* is in interference fit with the positioning slot 22, and the conducting section 32*b* is not in interference fit with the through slot 21.

Based on the above, among other things, the present invention has the following beneficial effects.

In the present invention, the conductive terminal 3 can be stably retained in the insulating body 20 by the interference fit of the positioning section 32*a* and the positioning slot 22, thus preventing the conductive terminal 3 from dropping from the seat 2 and vibrating to a large extent. Meanwhile, since the conducting section 32*b* and the through slot 21 are not in interference fit, in the process of assembling the conductive terminal 3 to the seat 2, the isolator 24 is not damaged, thus further avoiding short circuit between the shielding body 23 and the conductive terminal 3.

The method for manufacturing a shielded connector includes the following steps.

An insulating body 20 is formed by injection-molding and a bottom surface of the insulating body 20 is plotted to be a pre-plating side, so that the insulating body 20 has a plurality of through slots 21 recessed from the pre-plating side towards a top surface of the insulating body 20, and a plurality of positioning slots 22 in communication with the through slots 21 and formed through the top surface of the insulating body 20. An inner wall of the through slot 21 is inclined towards the pre-plating side of the insulating body 20. An inner wall of the positioning slot 22 is upright.

A conductive layer is plated from the pre-plating side towards the through slot 21 and the pre-plating side.

The insulating body 20 with the conductive layer is immersed in varnish, and then taken out and dried, so that an insulating layer is formed over the conductive layer.

A part of the insulating layer is removed, so that a part of the conductive layer of the pre-plating side is uncovered to form a lead-out portion.

A plurality of conductive terminals 3 is formed by stamping, so that each of the conductive terminals 3 includes a contact portion 31, a body portion 32 and a connecting portion 33 connected in sequence, and the body portion 32 has a positioning section 32*a* connected to the contact portion 31 and a conducting section 32*b* connecting the positioning section 32*a* and the connecting portion 33.

The conductive terminal 3 is disposed in the insulating body 20, so that the positioning section 32*a* is in interference fit with the positioning slot 22, and the conducting section 32*b* is in clearance fit with the through slot 21.

In other embodiments, the insulating layer may also be formed by painting or spraying, and the insulating layer may also be an ultraviolet curing paint layer or a polyurethane resin coating layer.

In other embodiments, the isolator 24 may not be disposed over the shielding body 23, and in this case, to avoid short circuit between the conductive terminal 3 and the shielding body 23, a notch 32*c* is disposed at an intersection of the conducting section 32*b* and the positioning section 32*a*.

FIG. 2 illustrates a second embodiment of present invention, which differs from the first embodiment in terms of the forms of the positioning slot 22, the through slot 21 and the conductive terminal 3, and the difference is described in detail as follows.

The insulating body 20 includes: a plurality of positioning slots 22, which are recessed inwards from the top surface of the insulating body 20 and are a blind hole (alternatively, the positioning slots 22 may also be through holes, as long as the inner walls of the positioning slots 22 are upright or are inclined towards the top surface of the insulating body 20 so that the sputtered metal particles are not deposited on the inner walls of the positioning slots 22 during vacuum sputtering), and a plurality of through slots 21 one-to-one corresponding to the positioning slots 22 and disposed adjacent to the positioning slots 22 side-to-side (alternatively, the numbers of the positioning slots 22 and the through slots 21 may be different according to the design requirements). A barrier 28 is disposed between each of the positioning slots 22 and a corresponding through slot 21. The through slot 21 is recessed from the bottom surface of the insulating body 20 towards the top surface of the insulating body 20, the through slot 21 is formed through the top surface of the insulating body 20, and the inner wall of the through slot 21 is inclined towards the bottom surface of the insulating body 20 and thus is exposed to the outside. The insulating body 20 is placed on a platform (not shown) and the top surface of the insulating body 20 is shielded by the platform, so that an open end of the positioning slot 22 is closed and the bottom surface of the insulating body 20 is exposed to the outside. In this manner, during vacuum sputtering, the sputtered metal ions enter the through slot 21 instead of the positioning slot 22 and are deposited on the inner wall of the through slot 21, thus forming the conductive body 25.

The conductive terminal 3 includes a contact portion 31 exposed outside the through slot 21 and electrically conducted with the mating electronic component, a body portion 32 extending from the contact portion 31, and a connecting portion 33 extending from the body portion 32, exposed outside the through slot 21 and electrically conducted with the motherboard.

The body portion 32 includes a connecting section 32*d* extending from the contact portion 31, a positioning section 32*a* extending from the connecting section 32*d* into the positioning slot 22 and in interference fit with the positioning slot 22 to retain the conductive terminal 3 in the insulating body 20, and a conducting section 32*b* extending from the contact portion 31 into the through slot 21 and in clearance fit with the through slot 21, thus avoiding short circuit between the uncovered shielding body 23 and the conductive terminal 3.

The body portion 32 further includes a notch 32*c* located at an intersection of the connecting section 32*d* and the conducting section 32*b*, thus avoiding short circuit between the conductive terminal 3 and the shielding body 23.

In this embodiment, since the forms of the conductive body 25 and the lead-out portion are the same as those of the above embodiment, so the details will not be described herein again.

In this embodiment, the method for manufacturing a shielded connector includes the following steps.

An insulating body 20 is formed by injection-molding and a bottom surface of the insulating body 20 is plotted to be a pre-plating side, so that the insulating body 20 has a plurality of through slots 21 recessed from the pre-plating side towards a top surface of the insulating body 20, and a plurality of positioning slots 22 separated from the through slots 21 by the barriers 28 respectively. The positioning slot 22 is recessed from the top surface towards the bottom surface of the insulating body 20 and is not formed through the pre-plating side of the insulating body 20. An inner wall of the through slot 21 is inclined towards the pre-plating side of the insulating body 20.

A conductive layer is plated from the pre-plating side towards the through slot 21 and the pre-plating side.

A plurality of conductive terminals 3 is formed by stamping, so that each of the conductive terminals 3 includes a contact portion 31, a body portion 32 and a connecting portion 33 connected in sequence, and the body portion 32 has a connecting section 32*d* connected to the contact portion 31, a positioning section 32*a* connected to the connecting section 32*d*, a conducting section 32*b* extending downwards from the contact portion 31, and a notch 32*c* located at an intersection of the positioning section 32*a* and the conducting section 32*b*.

The conductive terminal 3 is disposed in the insulating body 20, so that the connecting section 32*d* extends across the barrier 28, the positioning section 32*a* is in interference fit with the positioning slot 22, and the conducting section 32*b* is in clearance fit with the through slot 21.

In other embodiments, the positions of the through slot 21 and the positioning slot 22 may be inverted, and in this case, the inner wall of the through slot 21 is inclined towards the mating electronic component, and the conductive terminal 3 is mounted from the bottom surface of the insulating body 20 towards the top surface of the insulating body 20.

In other embodiments, the inner wall of the through slot 21 may also be upright, as long as the conductive layer is formed in the through slot 21 and on the pre-plating side in a proper manner and the conductive layer is not arranged in the positioning slot 22.

In other embodiments, the number of the lead-out portion may also be 1, 2, 3 or more.

The present invention, among other things, has the following beneficial effects.

(1) Since the positioning section 32*a* of the conductive terminal 3 is in interference fit with the positioning slot 22 where the shielding body 23 is not disposed, and meanwhile, the conducting section 32*b* of the conductive terminal 3 is not in interference fit with the through slot 21 where the shielding body 23 is disposed, the conductive terminal 3 can be stably retained in the insulating body 20 while avoiding short circuit between the conductive terminal 3 and the shielding body 23.

(2) Since the inner wall of the through slot 21 is inclined towards the bottom surface of the insulating body 20, and meanwhile, the positioning slot 22 is a blind hole and is opened towards the top surface of the insulating body 20, the objective of only forming the shielding body 23 in the through slot 21 and not forming the shielding body 23 in the positioning slot 22 can be achieved simply by placing the top surface of the insulating body 20 on a platform during vacuum sputtering.

(3) Since the insulating layer is formed simply by immersing the insulating body 20 in the varnish and then taking out and drying the insulating body 20, such a method can form a more uniform insulating layer at a higher efficiency than painting and spraying.

Although the preferred embodiments of the present invention are described in detail above, they are not intended to limit the scope of the present invention. Any equivalent variations or modifications made without departing from the spirit of the present invention shall fall within the scope of the present invention.

What is claimed is:

1. A shielded connector, electrically connecting a mating electronic component to a motherboard, comprising:

a seat, having an insulating body with a plurality of through slots formed through one side of the insulating body and a plurality of positioning slots further recessed from the corresponding through slots and formed through the other side of the insulating body, wherein a shielding body is disposed in the through slot and no shielding body is disposed in the positioning slot, at least one conductive body disposed outside the positioning slots and the through slots and connected to the shielding bodies, and at least one lead-out portion disposed outside the positioning slots and the through slots and electrically connecting the conductive body to the motherboard; and a plurality of conductive terminals, disposed in the insulating body, each having a contact portion exposed at one side of the insulating body and in electrical contact with the mating electronic component, a body portion extending from the contact portion, and a connecting portion extending from the body portion, exposed at the other side of the insulating body and electrically connected to the motherboard, wherein the body portion comprises a positioning section extending from the contact portion and in interference fit with the positioning slot, and a conducting section extending from the positioning section into the through slot and not in interference fit with the through slot.

2. The shielded connector according to claim 1, wherein the through slot shrinks from a surface of the insulating body adjacent to the motherboard towards the positioning slot.

3. The shielded connector according to claim 1, wherein an inner wall of the through slot is inclined towards a bottom surface of the insulating body.

4. The shielded connector according to claim 1, wherein a notch is disposed on the conductive terminal at an intersection of the through slot and the positioning slot.

5. The shielded connector according to claim 1, wherein an insulating layer is arranged over the shielding body of the through slot.

6. The shielded connector according to claim 5, wherein the insulating layer is an ultraviolet curing paint layer, a polyurethane resin coating layer or a varnish layer.

7. A shielded connector, electrically connecting a mating electronic component to a motherboard, comprising:

a seat, having an insulating body with a plurality of through slots formed through the insulating body and a plurality of positioning slots adjacent to the through slots and separated from the through slots by a barrier respectively, wherein a shielding body is disposed in the through slot and no shielding body is disposed in the positioning slot, at least one conductive body disposed outside the positioning slots and the through slots and connected to the shielding bodies, and at least one lead-out portion disposed outside the positioning slots and the through slots and electrically connecting the conductive body to the motherboard; and a plurality of conductive terminals, disposed in the insulating body, each having a contact portion exposed at one side of the insulating body and in electrical contact with the mating electronic component, a body portion extending from the contact portion, and a connecting portion extending from the body portion, exposed at the other side of the insulating body and electrically connected to the motherboard, wherein the body portion comprises a connecting section connected to the contact portion and extending across the barrier, a positioning section extending from the connecting section into the positioning slot and in interference fit with the positioning slot, and a conducting section extending from the contact portion into the through slot and not in interference fit with the through slot.

8. The shielded connector according to claim 7, wherein the positioning slot is a blind hole.

9. The shielded connector according to claim 7, wherein the positioning slot is a through hole.

10. The shielded connector according to claim 7, wherein the through slot gradually shrinks from a bottom surface of the insulating body towards a top surface of the insulating body.

11. The shielded connector according to claim 7, wherein an inner wall of the through slot is inclined towards a bottom surface of the insulating body.

12. The shielded connector according to claim 7, wherein a notch is disposed on the conductive terminal at an intersection of the through slot and the positioning slot.

* * * * *